United States Patent [19]

Smalley

[11] 4,069,937

[45] Jan. 24, 1978

[54] LINERLESS CLOSURE

[75] Inventor: Ned J. Smalley, Perrysburg, Ohio

[73] Assignee: Owens-Illinois, Inc., Toledo, Ohio

[21] Appl. No.: 763,476

[22] Filed: Jan. 28, 1977

[51] Int. Cl.[2] ..... B65D 41/04

[52] U.S. Cl. ..... 215/344; 215/DIG. 1

[58] Field of Search ..... 215/343, 344, DIG. 1

[56] References Cited

U.S. PATENT DOCUMENTS

| | | | |
|---|---|---|---|
| 3,255,909 | 6/1966 | Miller | 215/DIG. 1 |
| 3,286,866 | 11/1966 | McIntosh | 215/DIG. 1 |
| 3,814,274 | 6/1974 | McIntosh | 215/344 |

FOREIGN PATENT DOCUMENTS

| | | | |
|---|---|---|---|
| 274,657 | 9/1969 | Austria | 215/344 |

*Primary Examiner*—Donald F. Norton
*Attorney, Agent, or Firm*—A. J. Steger; E. J. Holler

[57] ABSTRACT

A linerless closure for a container having a neck portion terminating at its end in an annular rim defining the periphery of an open mouth, the closure including a top panel with a depending cylindrical skirt adapted to engage the neck of the container. A downwardly and outwardly depending annular sealing fin is provided on the inside of the top panel of the closure and is adapted to engage the annular rim of the container to close and seal the open mouth of the container. An annular wedge or stop member depends downwardly from the inside of the top panel at a location radially outwardly from the annular sealing fin and has and inwardly inclined lower surface adapted to bias or wedge the sealing fin into firm engagement with the annular rim of the container.

2 Claims, 2 Drawing Figures

LINERLESS CLOSURE

BACKGROUND OF THE INVENTION

This invention relates to sealing closures for use on containers, such as containers which have neck portions having threads or other configurations adapted to cooperate with similar configurations on the closures. This invention is more particularly directed to linerless closures, those that do not require a separate lining means or gasket to effect a seal on the container.

In the past, linerless closures of a variety of different types have been provided for sealing the open mouth at the upper end of the neck portion of containers. Such closures are generally molded from a plastic material and have a top panel from which a cylindrical skirt extends, the skirt having internal threads adapted to engage similar threads on the external surface of the neck of the container. A variety of different configurations of sealing fins and resilient beads have been suggested to provide a tight seal with the end of the neck of the container when the closure is tightened thereon. In addition, some of the linerless closure configurations require the provision of a special finish on the upper annular rim of the container neck.

One such linerless closure is taught by U.S. Pat. No. 3,255,909 (Ira H. Miller et al), wherein a sealing fin of a specific configuration is adapted to engage an inclined sealing portion on the upper annular rim of the container neck. This particular combination requires the modification of the container neck molds, in order to produce the required taper on the neck finish. In addition, sealing fins of the type disclosed in this patent have been known to experience cold flow or creep, so as to become elongated after they have been applied to the container. This phenomenon sometimes reduces the resiliency of the sealing fin and diminishes the desired tight seal between the sealing fin and the container neck finish.

Another such linerless closure is that disclosed in U.S. Pat. No. 3,814,274 (James A. McIntosh). This patent teaches a linerless closure which may be utilized on a standard container neck finish. It features a prebent annular sleeve and an annular bead which deflects outwardly to engage the tip of the annular sleeve to hold it in engagement with the container neck finish. However, because the annular bead is designed to deflect outwardly, only a portion of its flat lower surface engages the annular sleeve when the closure is applied to the container. In addition, the configuration of this flat bottom bead portion is not designed to compensate for cold flow creep or creep of the sealing fin upon repeated application.

SUMMARY OF THE INVENTION

It is, therefore, an object of this invention to provide an improved linerless closure which overcomes the deficiencies of such linerless closures taught by the prior art. The linerless closure of this invention is adapted to sealingly close the open mouth of a standard neck finish configuration. Thus, the improved linerless closure of this invention does not require the provision of special neck finish molds for the container.

The linerless closure of this invention provides a downwardly and outwardly depending annular sealing fin on the inside of the top panel of the closure which is adapted to engage the upper annular rim on the neck finish of the container. An annular wedge member depends downwardly from the inside of the top panel at a location radially outwardly from the annular sealing fin and has an inclined lower surface adapted to bias or wedge the sealing fin into constant sealing engagement with the annular rim of the container. The special configuration of the annular wedge, including the inclined lower surface, is adapted to contact the sealing fin and constantly bias the sealing fin into sealing engagement with the upper annular rim of the container neck. This wedge configuration is adapted to counteract cold flow or creep of the sealing fin upon application of the closure to the container by virtue of its inclined lower surface which provides a constant biasing or wedging action of the sealing fin against the upper annular rim of the container neck.

Other objects, features and advantages of the subject invention will become obvious upon reference to the following detailed description and the drawings illustrating a preferred embodiment thereof.

IN THE DRAWINGS

DETAILED DESCRIPTION OF A SPECIFIC EMBODIMENT OF THIS INVENTION

Figure 2:
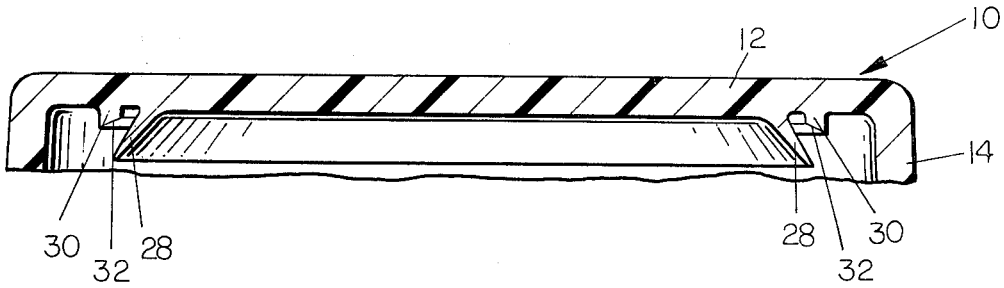
FIG. 2 is a partial sectional view of the improved linerless closure of this invention prior to its application to a container.
Figure 1:
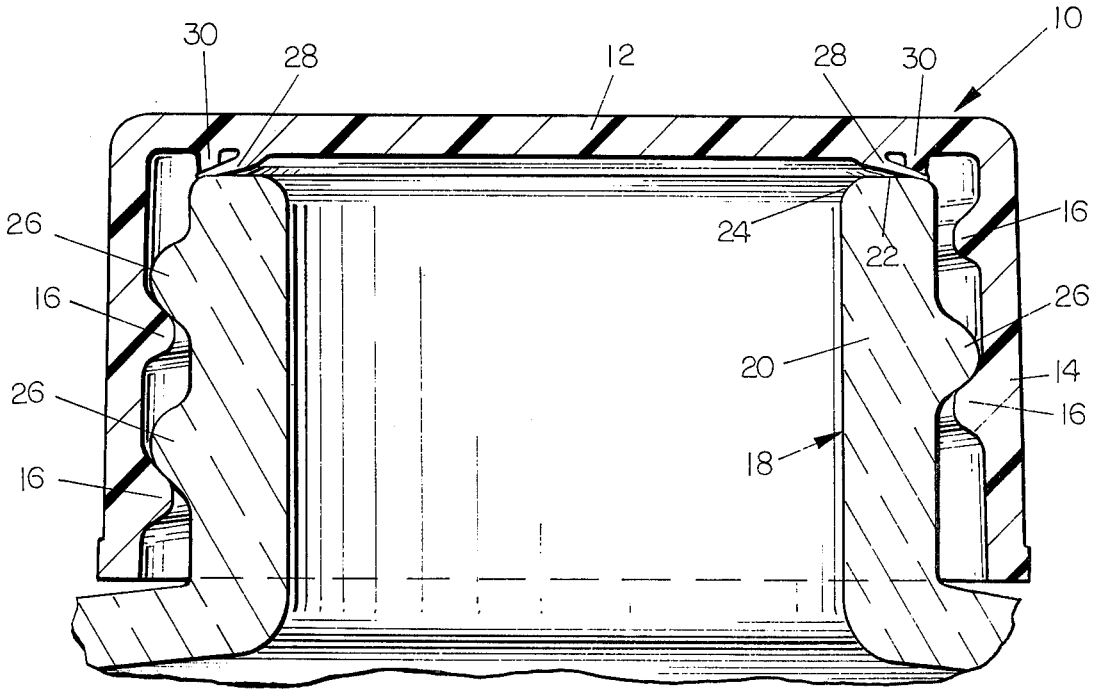
FIG. 1 is a sectional view of the improved linerless closure of this invention fully applied into sealing engagement with the neck portion of a container.

The improved linerless closure of this invention is illustrated in FIGS. 1 and 2 and referred to generally by the numeral 10. The closure 10 includes a top panel 12 and an annular skirt portion 14 which depends downwardly from the outer periphery of the top panel 12. The annular skirt 14 incorporates suitable engagement means, such as threads 16 which are adapted to mate with similar engagement means on a container. The closure 12 is adapted to be applied to a suitable bottle or container, indicated generally by the numeral 18. The container 18 includes a neck portion 20 which terminates at its end in an annular rim 22, which defines the periphery of an open mouth 24. The container neck portion 20 includes suitable engagement means, such as threads 26 which are adapted to matingly engage with the threads 16 on the closure 10.

The closure 10 of this invention may be applied into sealing engagement with the container neck portion 20 without the use of a separate liner means or gasket through the use of a unique combination of elements which are an integral part of the closure. An annular, flexible sealing fin 28 depends downwardly and outwardly from the inside surface of the top panel 12. This annular sealing fin 28 is adapted to engage the upper annular rim 22 on the container neck 20 so that the open mouth 24 on the container 18 may be closed and sealed by the closure 10. An annular wedge 30 is also provided on the inner surface of the top panel 12 and depends downwardly therefrom. The lower surface 32 of the annular wedge 30 is tapered or inclined toward the center of the closure 10 so that upon application of the closure 10 to the container 18, it contacts the sealing fin 28 to bias or wedge it into constant sealing engagement with the upper annular rim 22 of the container neck 20.

Thus, the unique inclined lower surface on the annular wedge 30 has been found to be extremely effective in maintaining a constant seal between the sealing fin 28 and the upper annular rim 22 of the container neck portion 20. Further, it has been found that, even after repeated applications of the closure to the container, the inclined lower surface on the wedge member tends to compensate for the inherent cold flow or creep of the sealing member to maintain an effective seal between the sealing fin and the upper rim of the container neck portion.

A preferred angle of inclination of the inclined surface 32 of the wedge 30 is approximately 65 degrees with respect to the longitudinal axis of the closure. The preferred angle of the outer surface of the sealing fin 28 in the relaxed condition (FIG. 1) is approximately 28 degrees with respect to the longitudinal axis of the closure.

Thus, the subject invention provides an improved linerless closure which is adapted to be used with standard neck finishes, thereby not necessitating the use of modified neck finish molds, and which also eliminates the sealing deficiencies associated with heretofore available linerless closures.

I claim:

1. A linerless closure for use with a container having externally threaded neck portion terminating at its end in an annular rim defining the periphery of an open mouth, said linerless closure comprising a top panel, an internally threaded skirt depending from said top panel and adapted to engage the threaded neck portion of said container, said skirt being substantially parallel to the longitudinal axis of said closure, an annular resilient sealing fin depending downwardly and outwardly from the inside surface of said top panel, said annular sealing fin adapted to sealingly engage said annular rim of the neck portion of the container, and an annular wedge member depending downwardly from the inside surface of said top panel at a location radially outwardly from said annular sealing fin, said annular wedge including a pair of unequal length sidewalls substantially parallel to the longitudinal axis of said closure and connected by a substantially flat, inwardly inclined lower surface, the width of said annular wedge being substantially equal to the length of the longer of said sidewalls, said inwardly inclined lower surface adapted to bias said annular sealing fin into sealing engagement with said annular rim of the neck portion of the container upon application of said linerless closure to said container.

2. A linerless closure, as set forth in claim 1, wherein the inclined angle between the inclined lower surface of said annular wedge member and the longitudinal axis of said closure is approximately 65°.

* * * * *